US006134780A

United States Patent [19]

Coughlan et al.

[11] Patent Number: 6,134,780

[45] Date of Patent: Oct. 24, 2000

[54] THERMALLY DECOUPLED SWIRLER

[75] Inventors: Joseph D. Coughlan, South Glastonbury; Alan J. Goetschius, Marlborough, both of Conn.

[73] Assignee: United Technologies Corporation, Hartford, Conn.

[21] Appl. No.: 09/391,992

[22] Filed: Sep. 9, 1999

Related U.S. Application Data

[62] Division of application No. 08/995,508, Dec. 22, 1997.

[51] Int. Cl.[7] ..... B23P 15/00

[52] U.S. Cl. ..... 29/889.2; 29/428

[58] Field of Search ..... 29/889.2, 428; 60/748, 39.32; 239/403, 399

[56] References Cited

U.S. PATENT DOCUMENTS 4,454,711 6/1984 Ben-Porat ..... 60/39.32

4,525,996 7/1985 Wright et al. ..... 60/39.31

4,686,823 8/1987 Coburn et al. ..... 60/39.32

4,914,918 4/1990 Sullivan ..... 60/756

5,117,624 6/1992 Roberts, Jr. et al. ..... 60/39.32

5,220,786 6/1993 Campbell ..... 60/39.32

*Primary Examiner*—I Cuda

[57] ABSTRACT

A swirler 50 for a gas turbine engine combustor 10 has an outer wall 54, groupings 52 of vanes 42 attached to the outer wall, a centerbody 60 mechanically decoupled from the outer wall via the groupings of vanes so that the swirler can accommodate differential rates of thermal growth between the outer wall and the inner centerbody and vanes. Alternatively, the centerbody may be attached to one of the groupings of vanes to keep the centerbody from vibrating.

1 Claim, 4 Drawing Sheets

50
54
42
56
52
58
60
62
64
66
68

THERMALLY DECOUPLED SWIRLER

This is a division of copending application Ser. No. 08/995,508, filed on Dec. 22, 1997.

TECHNICAL FIELD

The present invention relates to gas turbine engines and more particularly to the structure of a swirler in a combustion chamber therein.

BACKGROUND ART

Fuel systems in gas turbine engines, in order to bum fuel efficiently and to provide rapid burning, employ swirlers to evenly distribute a uniform fuel-air mixture within the combustion chamber. The swirlers, thus, facilitate the fuel-air mixture to complete the combustion reaction prior to exiting the chamber. Pressurized air from a conventional compressor positioned upstream of the combustor and fuel supplied from a fuel nozzle, are mixed upstream of the swirler. The fuel-air mixture in the combustion chamber is ignited to generate combustion gases.

Typically, swirlers include a centerbody having vanes extending radially outwardly therefrom. The vanes extend toward and are attached to an outer wall. The swirler extends into the interior of the combustion chamber and into the combustion zone through openings into the chamber.

During operation of the combustor, the swirler is bathed in hot combustion products from the ignition of the fuel in the combustion chamber. However, the inside of the swirler is cool as compared with the outside as the unignited fuel-air mixture channeled through the swirler vanes, is relatively cooler than the combustion products in the combustion zone surrounding the outer wall of the swirler. As a result, the outer wall of the swirler expands at a greater rate than the vanes or centerbody. A thermal gradient results between the hot outer wall and the cooler inner portion comprising the centerbody and vanes. The hot outer wall tries to expand as a function of its temperature, but is constrained by the cool centerbody and vanes which expand to a lesser extent.

Due to the differential thermal growth and movement between the outer wall and inner centerbody and vanes, the swirler experiences undesirable stress. There is a high probability that the stress will result in a crack in the outer wall. The crack will propagate as the fuel-air mixture enters the crack and is ignited by the surrounding combustion zone. The outer wall will then be burnt away compromising the durability of the swirler.

DISCLOSURE OF THE INVENTION

According to the present invention, a swirler includes an outer wall, groupings of vanes attached to the outer wall, a centerbody mechanically uncoupled from the outer wall and groupings of vanes wherein, the swirler accommodates differential rates of thermal growth between the outer wall, vanes and centerbody. The centerbody is retained in the swirler by attachment to a ring.

Alternatively, in one embodiment of the present invention, the centerbody is mechanically attached to only one of the groupings of vanes to keep the centerbody from vibrating.

A primary advantage is the durability of the swirler of the present invention that results from the mechanically and thermally decoupled centerbody. The swirler of the present invention accommodates the different rates of thermal growth of the outer wall and the inner centerbody and vanes and thereby does not experience stress induced by thermal gradients between the swirler components.

Another advantage is the ease and cost of manufacturing and incorporating into the combustion chambers of the prior art, the swirler of the present invention. The components of the swirler are identical to those of the prior art. The uncoupling of the centerbody of the swirler of the present invention does not require new tooling. Thus, the simplicity of the structure of the swirler and the use of existing tooling, enables for a cost effective manufacturing process. Further, swirlers of the prior art can be retrofitted to include the present invention in a cost-effective manner.

The foregoing and other objects, features and advantages of the present invention will become more apparent in the following detailed description of the best mode for carrying out the invention and from the accompanying drawings which illustrate an embodiment of the invention.

BEST MODE FOR CARRYING OUT THE INVENTION

Figure 1:
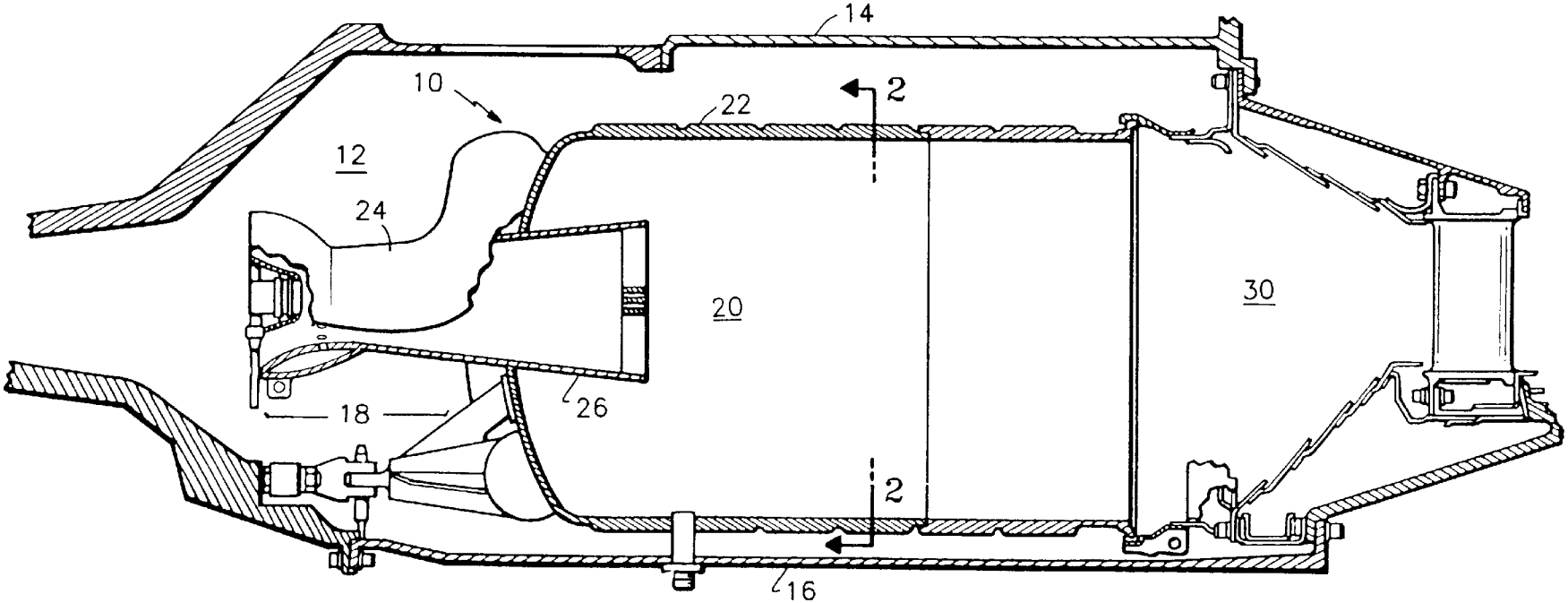
FIG. 1 is a simplified, partially broken away, cross-sectional view of a combustor installed in a gas turbine engine.

Referring to FIG. 1, combustors 10 (only a single combustor is shown) are circumferentially spaced about an engine in an annulus 12 between an inner engine case 14 and an outer engine case 16. The combustor 10 includes a fuel-air mixing zone 18 and a combustion zone 20 which is formed by a cylindrical body 22. Pressurized air supplied from a compressor (not shown) and fuel supplied from a fuel supply system, not shown as the details are not important for the understanding of the present invention, are mixed in the fuel-air mixing zone 18. The fuel-air mixing zone 18 includes a plurality of primary mixing tubes 24 which provide the fuel-air mixture for combustion during startup and low power operating conditions. Also included in the fuel-air mixing zone 18 is a single secondary mixing tube 26 which provides additional fuel-air mixture during high power operating conditions. The secondary mixing tube 26 is axially oriented with respect to the combustion chamber and is positioned near, but not necessarily coincident with, the axis of the combustion chamber. The combustor 10 discharges through a transition duct 30 to a turbine section (not shown) which extracts work from the combustion products to power the compressor.

Figure 2:
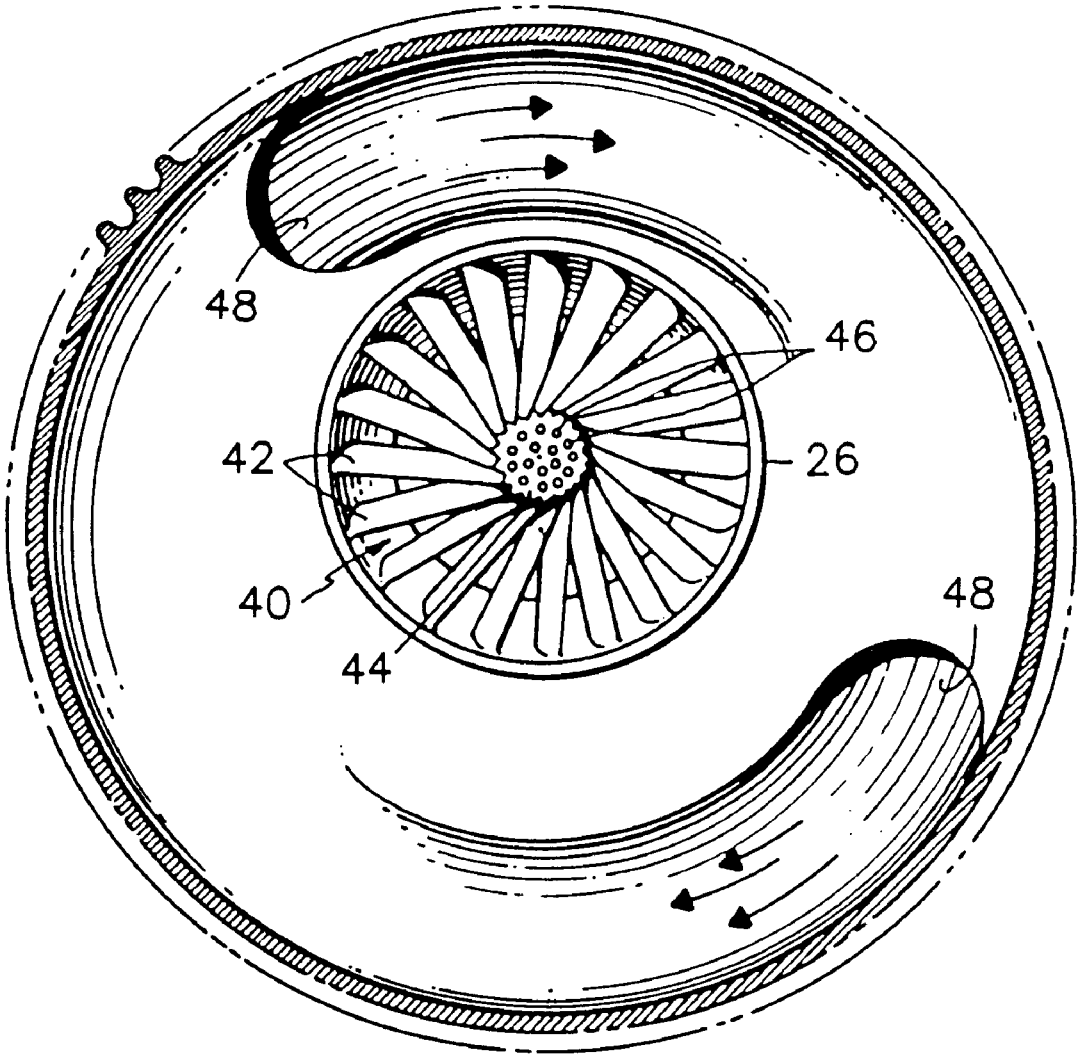
FIG. 2 is a cross-sectional view taken along lines 2—2 of FIG. 1, showing a typical swirler.

Referring to FIG. 2, the downstream end of the secondary mixing tube 26 has an exit swirler 40 disposed thereacross. The swirler 40 is comprised of a plurality of exit vanes 42 for imparting a circumferential swirl to the fuel-air mixture flowing through the secondary mixing tube 26. A centerbody 44 having a plurality of holes 46 disposed therein, is positioned at the center of the mixing tube 26. Each of the primary mixing tubes 24 (see FIG. 1) discharges into the combustion chamber through a corresponding aperture 48. The vanes 42 are angled to provide flow rotating counter to the flow discharged through the apertures 48 of the primary mixing tubes 24.

Figure 4:
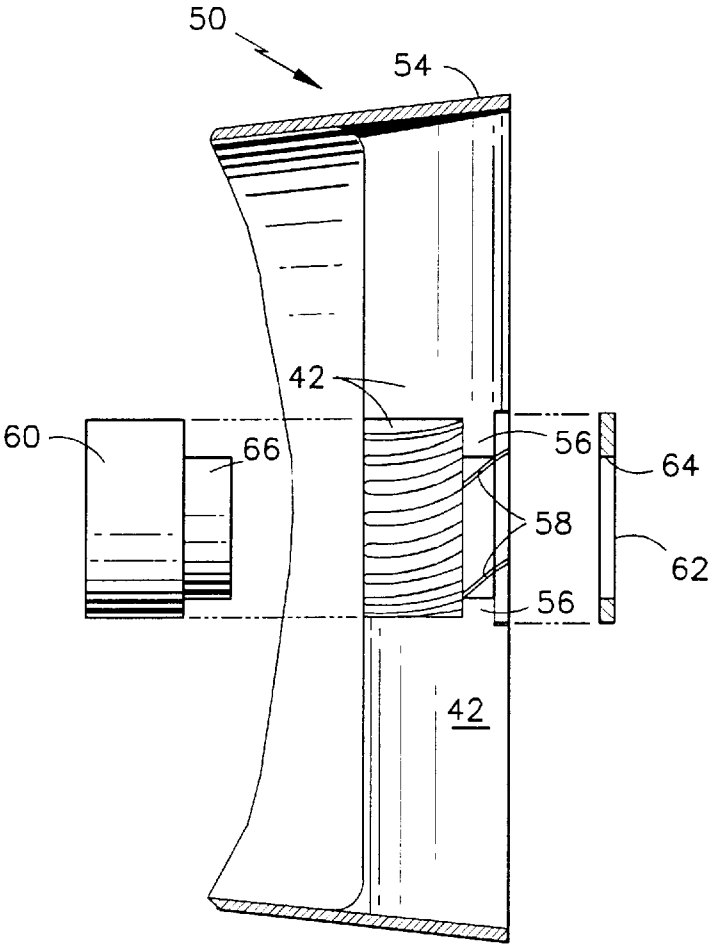
FIG. 4 is a cross-sectional view taken along lines 4—4 of FIG. 3 showing the present invention swirler.
Figure 3:
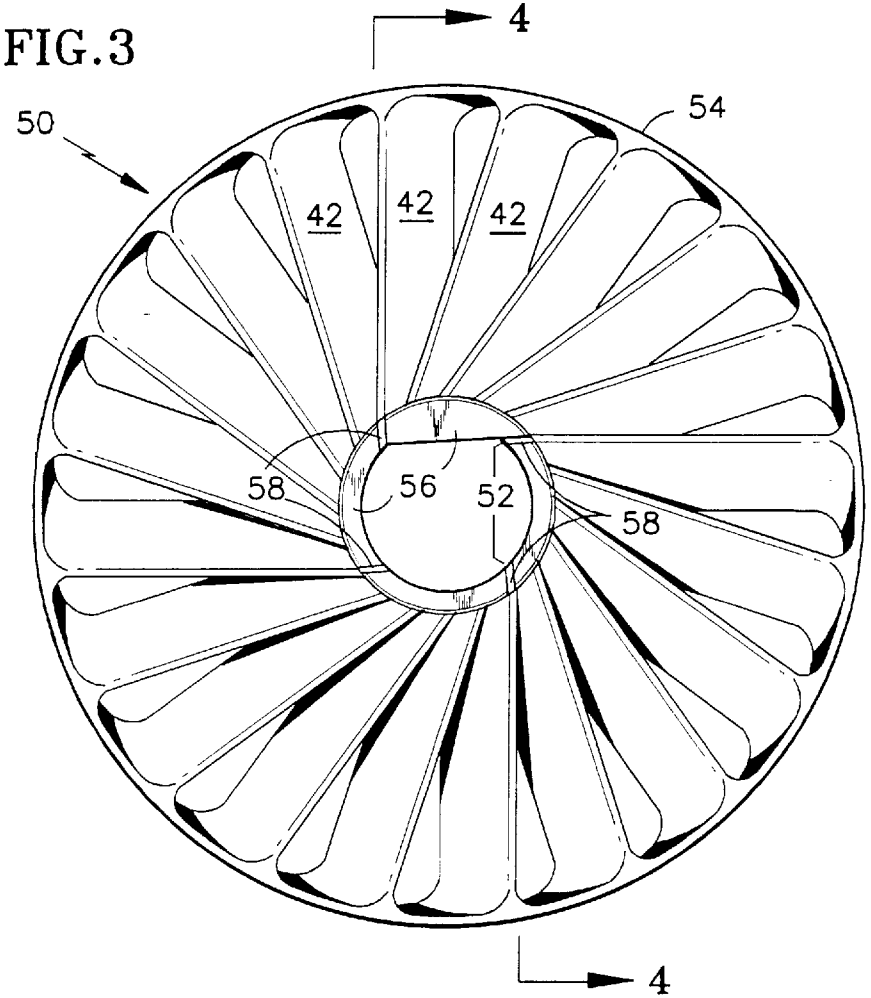
FIG. 3 is a front elevation view of a swirler of the present invention enlarged to show details of the swirler components.

Referring to FIGS. 3 and 4, the swirler 50 of the present invention includes groupings 52 of vanes 42. The radially extending groupings of vanes are attached to an outer wall 54. The groupings 52 of vanes 42 are mechanically detached from each other. The detachment between the groupings of vanes is at the base 56 of the groupings of the vanes, as represented by cuts 58. The centerbody 60 is mechanically decoupled from the outer wall via the groupings of vanes. This decoupling is achieved by cutting centerbody 60 away from the base 56 of the groupings of vanes. The centerbody 60 is held in place in the swirler by being attached (as by welding) to a retaining ring 62.

Figures 5, 6:
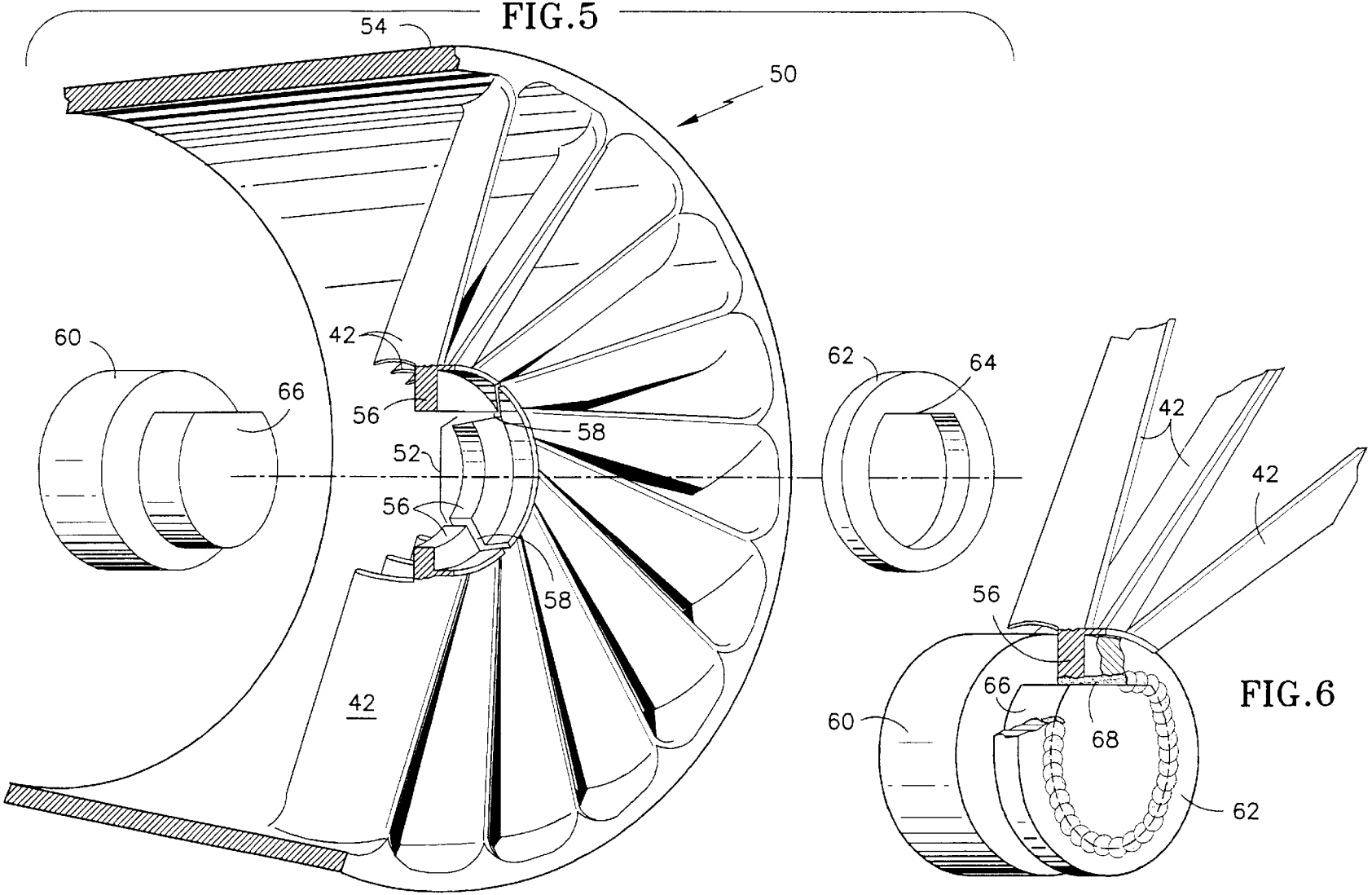
FIG. 5 is an exploded, partially broken away, perspective view showing the disassembled components of the present invention swirler.
FIG. 6 is a perspective view showing the attachment of the components of the present invention swirler.

Referring to FIGS. 5 and 6, stresses induced by thermal gradients between the outer wall and the inner centerbody and vanes are relieved by uncoupling the centerbody from all but one of the groupings of vanes. It will be appreciated that the centerbody can be detached from all of the groupings of vanes.

In one embodiment of the present invention, the inner surface 64 of the retaining ring 62 is D-shaped. The centerbody 60 has a complementary inner surface 66 that mates with the D-shaped retaining ring. This D-shaped configuration provides an anti-rotational feature so that the centerbody does not rotate with respect to the groupings of vanes. The high vibrational environment inherent in the combustor could cause the uncoupled centerbody to rotate in the center of the swirler.

Further, to keep the centerbody 60 from vibrating in the swirler 50 due to the aforementioned vibrational environment inherent in the combustion chamber, the centerbody and retaining ring are attached to one of the groupings 52 of vanes 42. As shown in FIG. 6, the attachment between the centerbody 60 and retaining ring 62 can be provided by welding the two mating surfaces 66 and 64 together and then welding the combination to one of the groupings 52 of vanes 42 as represented by the welded joint 68.

During operation of the combustor, unignited fuel-air mixture is channeled through the swirler vanes 42. This fuel-air mixture is cooler than the combustion products in the combustion zone surrounding the outer wall 54 of the swirler 50. As a result, the outer wall of the swirler expands at a greater rate than the vanes or centerbody 60. The hotter outer wall can expand as a function of its temperature as it is mechanically detached from the centerbody. Thus, the centerbody cannot constrain the expansion or contraction of the outer wall and undesirable stresses are not imposed on the swirler.

Another aspect of the present invention is that prior art swirlers can be made into the present invention swirler. The process to convert the prior art swirlers into the present invention swirler includes cutting out the centerbody to remove a central plug, mechanically detaching groupings of vanes, reinserting a central plug, attaching a retaining ring to the central plug, and attaching the retaining ring and central plug to one of the groupings of vanes. Thus, a mechanically detached centerbody results which provides for a durable swirler. As the centerbody is attached only to one of the groupings of vanes, it can accommodate differential rates of thermal growth of the outer wall and the inner centerbody and vanes.

Another advantage is the ease and cost of manufacturing and incorporating into the combustion chambers of the prior art, the swirler of the present invention. The simplicity of the structure of the swirler and the use of existing tooling, enables a cost effective manufacturing process. Further, swirlers of the prior art can be retrofitted to include the present invention in a cost-effective manner.

Although the invention has been shown and described with respect to detailed embodiments thereof, it should be understood by those skilled in the art that various changes in form and detail thereof may be made without departing from the spirit and the scope of the claimed invention.

What is claimed is:

1. A process for forming a thermally decoupled swirler having a centerbody, a plurality of radially extending vanes and a outer wall, comprising the steps of:

a) cutting out a central plug from the centerbody;

b) mechanically detaching groupings of vanes by sectioning the centerbody attachment between the vanes;

c) reinserting a central plug;

d) attaching a retaining ring to the central plug; and e) attaching the retaining ring and central plug to one group of vanes.

* * * * *